US006128857A

United States Patent [19]

Morgan et al.

[11] Patent Number: 6,128,857

[45] Date of Patent: Oct. 10, 2000

[54] LOUVER SHUTTER HAVING DECORATIVE LOUVER INSERTS

[75] Inventors: Joe N. Morgan, Otterbein; Jay R. Cleaver, Lafayette; John J. Bufkin, Rensselaer; John W. Click, Lafayette, all of Ind.

[73] Assignee: Lafayette Venetian Blind, Inc., West Lafayette, Ind.

[21] Appl. No.: 09/373,695

[22] Filed: Aug. 13, 1999

Related U.S. Application Data

[63] Continuation of application No. 08/878,315, Jun. 18, 1997, abandoned.

[60] Provisional application No. 60/021,148, Jun. 28, 1996.

[51] Int. Cl.[7] ..... E06B 7/08

[52] U.S. Cl. ..... 49/74.1; 49/92.1

[58] Field of Search ..... 49/74.1, 92.1; 160/236; 40/453, 618

[56] References Cited

U.S. PATENT DOCUMENTS

| | | | |
|---|---|---|---|
| 3,472,305 | 10/1969 | Lefes | 160/236 |
| 4,049,038 | 9/1977 | Hyman et al. . | |
| 4,195,680 | 4/1980 | Hyman et al. . | |
| 4,628,980 | 12/1986 | LeHouillier | 160/236 |
| 5,029,628 | 7/1991 | Lemay | 160/236 |
| 5,050,662 | 9/1991 | Kellener | 160/236 |
| 5,216,837 | 6/1993 | Cleaver et al. | 49/74.1 |
| 5,236,166 | 8/1993 | Darling | 40/618 |
| 5,269,361 | 12/1993 | Ryden | 160/236 |
| 5,458,307 | 10/1995 | Gebka | 40/618 |
| 5,572,831 | 11/1996 | Rafiqui | 160/236 |
| 5,613,542 | 3/1997 | Tuzmen et al. . | |
| 5,655,589 | 8/1997 | Vartanian | 160/236 |
| 5,718,273 | 2/1998 | Best et al. | 160/236 |

*Primary Examiner*—Daniel P. Stodola
*Assistant Examiner*—Curtis A. Cohen
*Attorney, Agent, or Firm*—Woodard, Emhardt, Naughton, Moriarty & McNett

[57] ABSTRACT

A louver shutter is disclosed which employs generally a plurality of louvers and a frame containing the louvers. The frame includes first and second stiles connected with first and second rails. The louvers have ends rotationally mounted to the rails and have inner and outer facing surfaces. The inner facing surface has a groove extending lengthwise between the louver ends. A plurality of decorative inserts are rigidly attached to a corresponding one of the louvers on the inner facing surface within the groove.

7 Claims, 3 Drawing Sheets

LOUVER SHUTTER HAVING DECORATIVE LOUVER INSERTS

This application is a continuation of Ser. No. 08/878,315 filed on Jun. 18, 1997 which is now abandoned. This application claims the benefit of Provisional Application No. 60/021,148 filed Jun. 28, 1996.

BACKGROUND OF THE INVENTION

The present invention relates generally to shutters for windows, doors and other openings, and, in particular, to improvements in shutters having pivoting louvers.

Decorative shutters employing a plurality of louvers for selectively controlling the degree of light permitted through are well known in the art. Such shutters are often provided with a louver mechanism for linking together the movement of the louvers so that they pivot in unison. Many of these mechanisms employ a tilt rod positioned external of the louvered panel to actuate the louvers. Enclosed louver actuating mechanisms are also well known. One such type of mechanism is disclosed in U.S. Pat. No. 5,216,837 to Cleaver et al. Advantages of enclosed mechanisms are that they provide a more aesthetically pleasing look by virtue of hiding the actuating mechanism and allow for a greater degree of pivoting range than tilt-rod actuated louvers which sometimes interfere with the louver movement.

While improvements such as enclosed louver mechanisms have increased the aesthetic beauty of the shutters, little has been done to improve the visual appearance of the louvers themselves. Typically, the louvers are either painted or, if made of a high quality wood material, varnished, stained or coated to show the wood texture. Since the visual aesthetics of a window or other opening are often enhanced with fabric draperies to provide a "softer" look, a need exists to coordinate these decorative materials with the shutter without compromising the appearance of the shutter from the outside.

SUMMARY OF THE INVENTION

A louver shutter is disclosed in one embodiment of the present invention including a plurality of louvers and a frame containing the plurality of louvers. The frame includes first and second stiles connected with first and second rails. The louvers have ends pivotably mounted to the rails and have inner and outer facing surfaces with the inner facing surface having a groove extending lengthwise between the louver ends. A plurality of decorative inserts are rigidly attached to a corresponding one of the louvers on said inner facing surface within the groove.

One object of the present invention is to provide an improved louver shutter.

Another object of the present invention is to provide a louver shutter wherein the interior facing side of the louvers are provided with decorative inserts having a more pleasing decorative look which can be matched or coordinated with the color, style, patterns of interior draperies, pillows, wall coverings, furniture while the outer facing side of the louvers is consistent with the exterior presentation of the building.

Related objects and advantages of the present invention will become apparent from the following drawings and detailed description.

DESCRIPTION OF THE PREFERRED EMBODIMENT

Figure 1A:
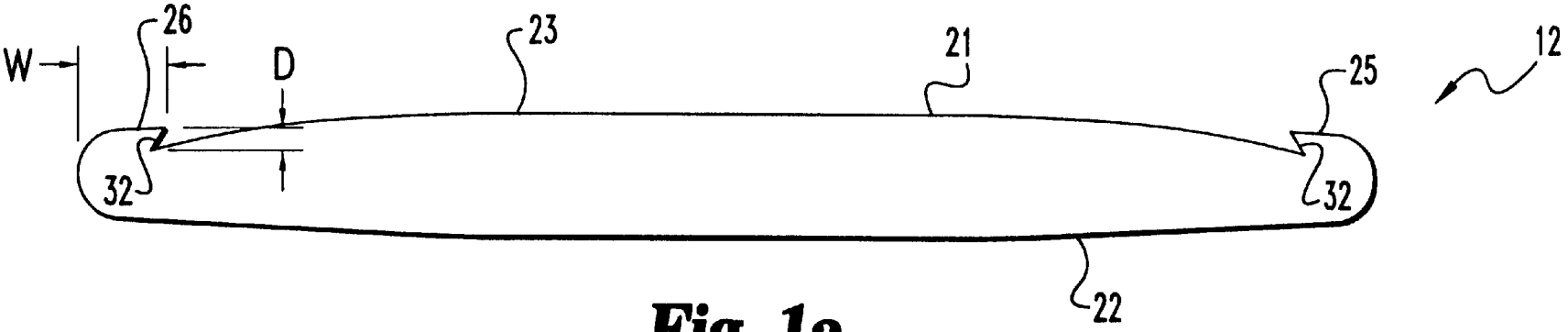
FIG. 1*a* is a side elevation view depicting one of the louvers of the shutter of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
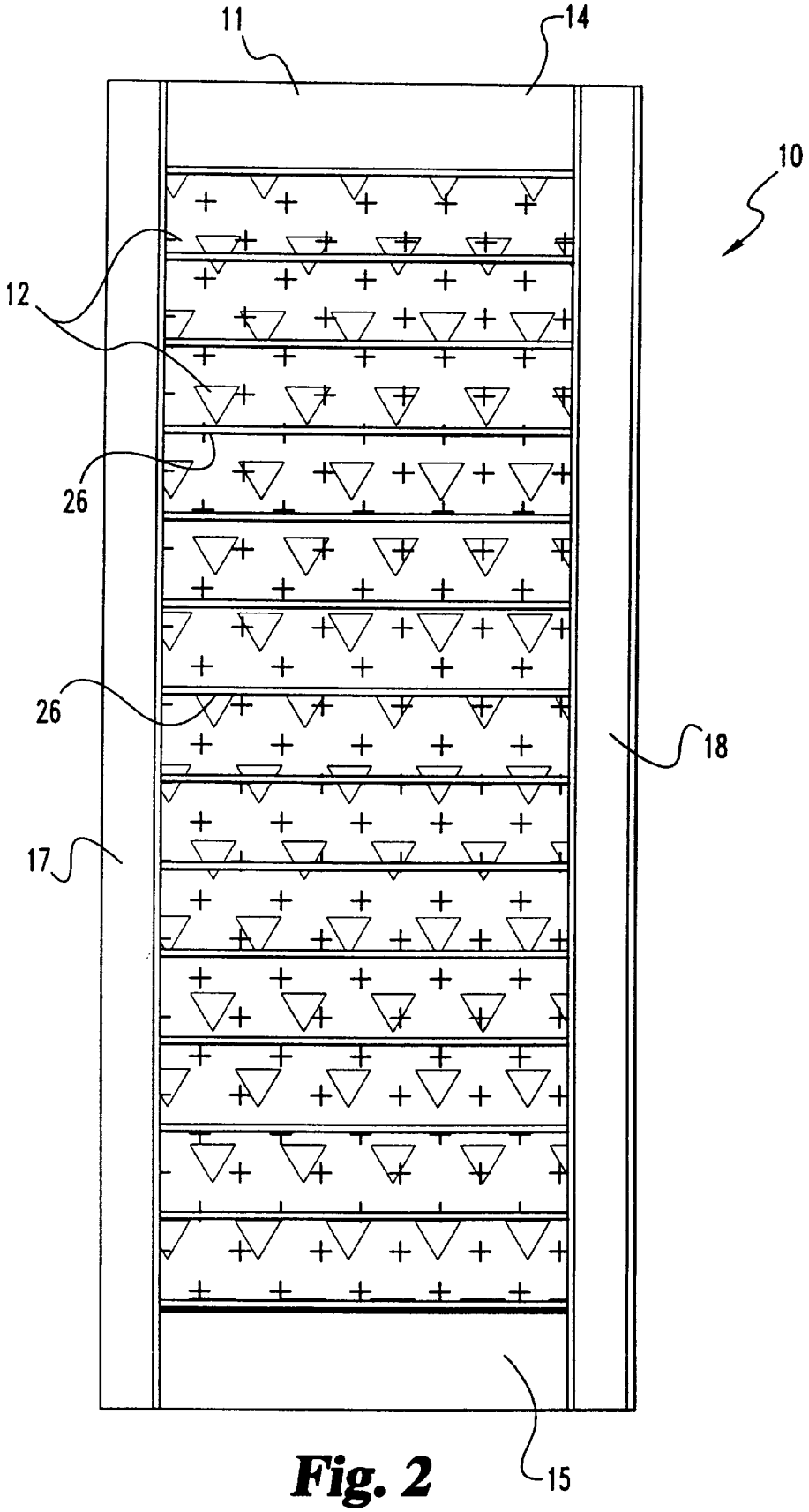
FIG. 2 is an elevation view of the interior facing side of the shutter of the present invention with the louvers in the fully closed position.

Referring now to FIG. 2, a louvered shutter 10 is shown including generally a frame 11 containing a plurality of louvers 12 rotationally mounted therein. Frame 11 includes stiles 14 and 15 in connection with rails 17 and 18. In the preferred embodiment, frame 11 is constructed of wood and employs generally a tongue-in-groove construction held together by a combination of adhesives and fasteners. Other materials and constructions known in the art are also contemplated. For example, frame 11 can be constructed of molded plastic or extruded aluminum members and employ fasteners to connect its various components.

Preferably, louver shutter 10 is adapted for placement adjacent to or in connection with like louver shutters. For example, shutter 10 might be hinged to an adjacent like shutter to provide a folding window covering. Flange and groove type connections may also be used to adjoin louver shutters.

Each of the individual louvers 12 are rotationally mounted at their ends 19 to rails 17 and 18. In the preferred embodiment, an enclosed louver actuating mechanism (not shown) simultaneously actuates rotation of the louvers between an open position which permits light to pass between openings in the louvers and the fully closed position depicted in FIG. 1. A preferred enclosed louver actuating mechanism is disclosed in applicant's commonly owned U.S. Pat. No. 5,216,837 entitled "Enclosed Louver Mechanism" and is hereby incorporated herein by reference. Alternatively, although less preferably, standard external type actuating mechanisms such as tilt rods may also be employed. The louvers 12 are relatively closely spaced to one another so that rotation is limited by interference between adjacent louvers and eliminating light gaps in the fully closed position.

Figure 1B:
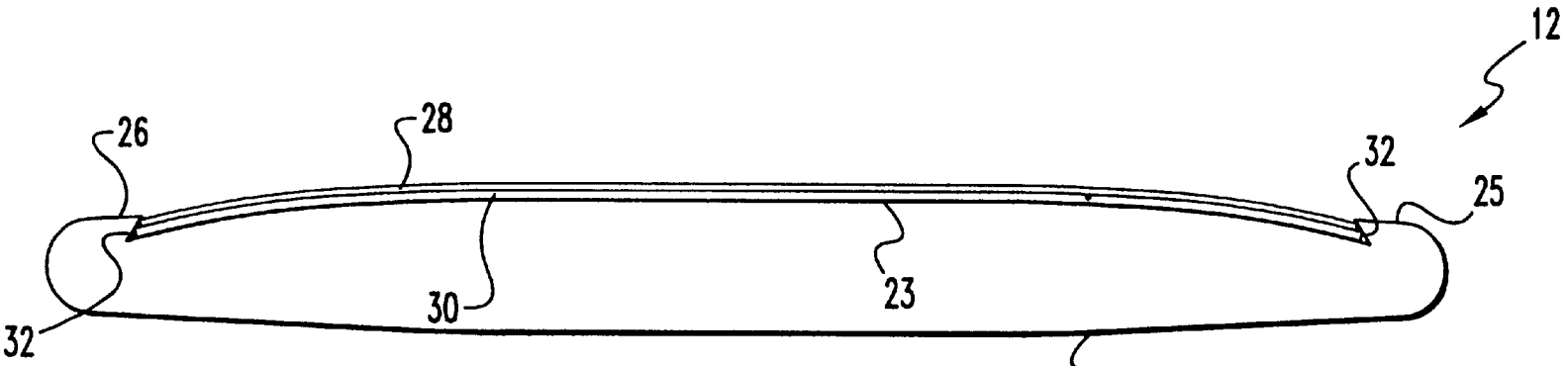
FIG. 1*b* is a side elevation view depicting the louver of FIG. 1 with a decorative insert mounted thereto.
Figure 3:
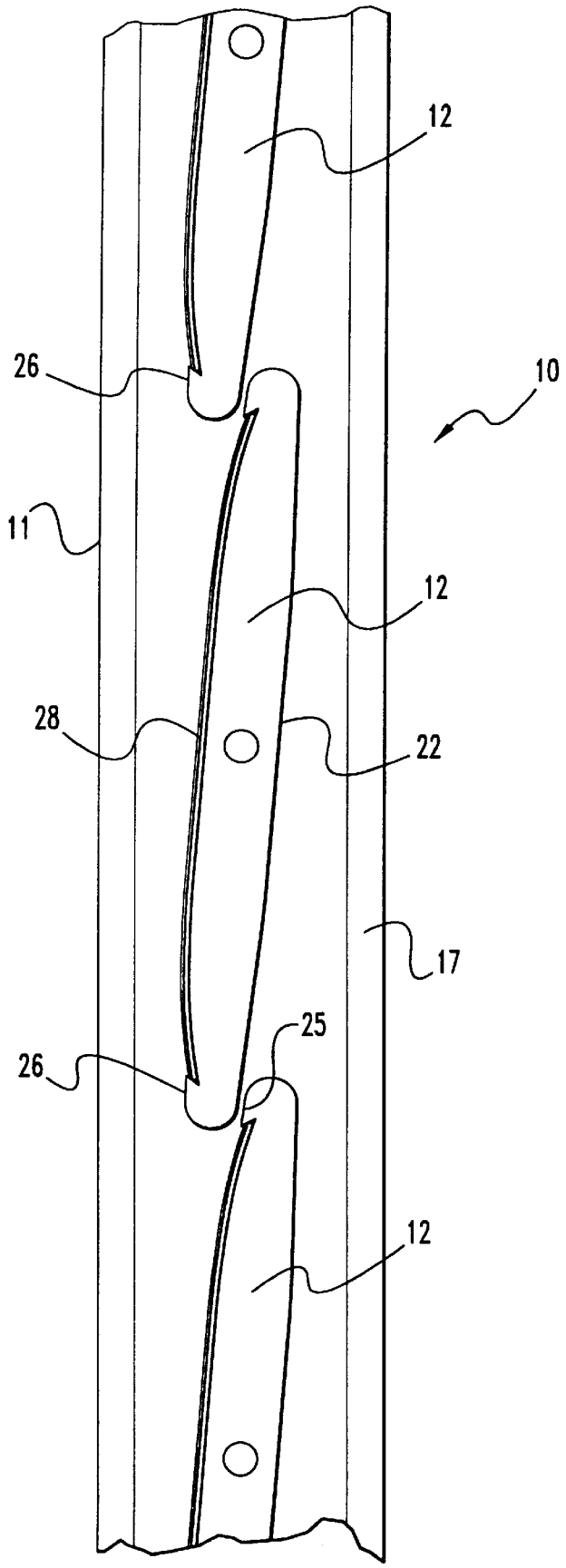
FIG. 3 is a partial side elevation view of the louvers in the fully closed position.

Referring now also to FIGS. 1*a*, 1*b* and 3, the construction of the individual louvers is shown in greater detail. Each louver 12 has an inner facing surface 21 which is intended to face the interior of the building structure and an outer facing surface 22 which is intended to face outside the structure. The inner facing surface 21 is formed to have a groove 23 bounded by ribs 25 and 26. In the fully closed position depicted in FIG. 1, only the rib 26 adjoining the leading edge of the louvers 12 is visible, so as to provide a more pleasing aesthetic appearance. Accordingly, the width "w" of rib 25 is sized so as not to exceed the dimension which the adjoining louver 12 overlies it in the fully closed position.

Within each of the grooves 23 is attached a decorative insert 28. It is intended that the decorative insert 28 be a strip of fabric material matched to a fabric scheme used in the interior room such as on draperies, pillows, covers, etc. In the preferred embodiment, the insert 28 is rigidly secured to louver 12 within groove 23 by a strip 30 of double-sided adhesive tape. One preferred such tape is Model 950 5 mil. high tacking adhesive transfer tape sold by 3M Company of St. Paul, Minn. Alternatively, it may also be deemed desirable to secure insert 28 to louver 12 so that it may be removed and replace with a different decorative insert to allow for redecorating without needing to entirely replace shutter 10. It is therefore contemplated that non-permanent adhesives or other removable bonders or fasteners could also be employed.

In order to provide a smooth continuous appearance, the depth "d" of groove 23 is sized to correspond closely to the thickness of the insert 28 and strip 30. Accordingly, the depth of groove 23 is nominally sized at about 1/16 inch. In order to reduce fraying of insert 28 and delamination from louver 12 over long periods of time, groove 23 is provided with undercuts 32 which receive the marginal edges of insert 28. As seen in the drawings, the undercuts 32 extend at about a 45 degree angle relative to the surface of ribs 25 and 26.

It may be appreciated that because the decorative inserts 28 covers only the inner facing surfaces of the louvers 12 that the appearance of the shutter 10 from the exterior can be a natural wood or painted finish consistent with the building's exterior appearance while allowing for a "softer" fabric look from the interior consistent with the interior decor.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A louver shutter, comprising:

a plurality of louvers;

a frame containing said plurality of louvers, said frame including first and second stiles connected with first and second rails, said louvers having ends rotationally mounted to said rails and having inner and outer facing surfaces, one of said inner facing surfaces having a groove extending lengthwise between said ends; and a plurality of decorative fabric inserts, each of said inserts (rigidly) attached by an adhesive to a corresponding one of said louvers on said inner facing surface within said groove, said groove bounded by ribs and provided with undercuts extenting at about an angle of 45 degrees relative to the surface of said ribs.

2. The shutter of claim 1 wherein said insert is a sheet of uniform thickness and the depth of said groove is sized to accommodate the thickness of said insert.

3. The shutter of claim 2 wherein the depth of said groove being nominally sized at about 1/16 inch.

4. The shutter of claim 2 wherein each of said inserts is adhesively bonded to a corresponding one of said louvers by a double-side adhesive strip.

5. The shutter of claim 1 wherein said louvers rotate in unison between open and closed positions, said louvers being positioned so that adjacent louvers overlie one another in said closed position, each of said louvers having leading and trailing ribs extending along the margins of said inner facing surface, and wherein the width of said trailing rib is no greater than the overlap between adjacent louvers in said closed position.

6. The shutter of claim 1 wherein said inserts are removably mounted to said louvers within said grooves.

7. A louver shutter, comprising:

a plurality of louvers;

a frame containing said plurality of louvers, said frame including first and second stiles connected with first and second rails, said louvers having ends rotationally mounted to said rails and having inner and outer facing surfaces, one of said inner facing surfaces having a groove extending lengthwise between said ends; and a plurality of decorative fabric inserts, each of said fabric inserts directly adhesively attached to a corresponding one of said louvers on said inner facing surface within said groove, said groove bounded by ribs and provided with undercuts extending at about an angle of 45 degrees relative to the surface of said ribs, said undercuts overlying the marginal edges of said inserts.

* * * * *

UNITED STATES PATENT AND TRADEMARK OFFICE

CERTIFICATE OF CORRECTION

PATENT NO. : 6,128,857
DATED : October 10, 2000
INVENTOR(S) : Joe N. Morgan et al.

It is certified that error appears in the above-identified patent and that said Letters Patent is hereby corrected as shown below:

Title page,
Item [56], please add the following immediately preceding "4,628,980"
-- 4,276,954 7/1981 Romano . . . . . 160/236 --
Item [56], please add the following immediately preceding "5,458,307"
-- 5,394,925 3/1995 Ives . . . . . 160/236 --.

Signed and Sealed this

Fifth Day of March, 2002

*Attest:*

*Attesting Officer*

JAMES E. ROGAN
*Director of the United States Patent and Trademark Office*